United States Patent [19]

Yokovama et al.

[11] Patent Number: 4,681,313

[45] Date of Patent: Jul. 21, 1987

[54] PHOTOSENSITIVE PAPER CONVEYING DEVICE OF A COPYING MACHINE

[75] Inventors: Yasuyuki Yokovama; Kiyoaki Nakamura, both of Hachioji; Hiroshi Goi, Tachikawa; Koichiro Fujioka, Yokohama, all of Japan

[73] Assignee: Iwatsu Electric Co., Ltd., Tokyo, Japan

[21] Appl. No.: 798,597

[22] Filed: Nov. 15, 1985

[30] Foreign Application Priority Data

Nov. 29, 1984 [JP] Japan ..... 59-250395

[51] Int. Cl.[4] ..... B65H 5/06

[52] U.S. Cl. ..... 271/273; 355/14 SH

[58] Field of Search ..... 271/273, 274; 355/14 SH

[56] References Cited

U.S. PATENT DOCUMENTS 4,043,661 8/1977 Yamada et al. .

4,172,653 11/1979 Bujese .

FOREIGN PATENT DOCUMENTS 8302348 7/1983 World Int. Prop. O. ..... 271/273

OTHER PUBLICATIONS

Xerox Disclosure Journal, vol. 6, No. 2, pp. 53, 54, Mar./Apr. 1981, "Drive Mechanism for Paper Feed Rollers", Mitrovich et al.

*Primary Examiner*—Richard A. Schacher

*Attorney, Agent, or Firm*—Paul & Paul

[57] ABSTRACT

A moving original exposure type of copying machine comprising, an original carrier reciprocatively moving on a machine body, a group of rollers conveying a photosensitive paper synchronously with the reciprocal movement of the original carrier, an image-forming station forming an image on a photosensitive paper, the group of photosensitive paper conveying rollers including a first pair of rollers located apart from and upstream of the image-forming station, holding therebetween and conveying a photosensitive paper, and including a second and a third pairs of rollers positioned adjacent to and upstream and downstream of the image-forming station, holding therebetween and conveying a photosensitive paper, the first rollers being provided with release means whereby a photosensitive paper held by the first rollers is released when the paper passes the image-forming station.

6 Claims, 3 Drawing Figures

PHOTOSENSITIVE PAPER CONVEYING DEVICE OF A COPYING MACHINE

BACKGROUND OF THE INVENTION

1. Field of the Invention

The present invention relates to a photosensitive paper conveying device of a copying machine in which a photosensitive paper is conveyed at a certain relationship to the movement of an original carrier, and at the same time, an image is formed on the photosensitive paper.

2. Description of the Related Art

In a conventional copying machine, when a photosensitive paper is conveyed to an image-forming station, usually pairs of rollers are located upstream and downstream of the photosensitive paper, respectively, these pairs of rollers holding the photosensitive paper therebetween and conveying the paper in a certain direction at a constant speed.

In such a conventional photosensitive paper conveying device, when the trailing end of the photosensitive paper leaves the pair of upstream rollers, the photosensitive paper is released from the influence of the upstream rollers, for example, pressure between the rollers and friction force with the rollers, and thus the pair of downstream rollers do not rotate correctly. Consequently, the photosensitive paper is not properly conveyed to the image-forming station. Thus, in a copying machine in which an original carrier and a photosensitive paper move together at a certain relationship to each other, and at the same time, an image is formed on the photosensitive paper, the image becomes blurred and thus it is impossible to reproduce an exact copy of an original image on the photosensitive paper.

SUMMARY OF THE INVENTION

The object of the present invention is to provide a copying machine in which a photosensitive paper is conveyed to an image-forming station at a certain relationship between the movement of an original carrier and that of the photosensitive paper, uneven rotation of the conveying rollers at the image-forming station is prevented, blurring of an image on the photosensitive paper does not occur, and thus, an exact copy of the original image can be reproduced on the photosensitive paper at the image-forming station.

According to the present invention, there is provided a photosensitive paper conveying device of a copying machine comprising: a body; an original carrier movably mounted on the body; a photosensitive paper receiving member attached to the body; an exposure (image-forming) station for forming an image on a photosensitive paper; photosensitive paper conveying means located downstream of the photosensitive paper receiving member and operating to convey a photosensitive paper from the photosensitive paper receiving member to the image-forming station. The photosensitive paper conveying means includes a first pair of rollers located apart from the image-forming station and between the photosensitive paper receiving member and the image-forming station, holding therebetween and conveying a photosensitive paper, and including a second and a third pairs of rollers positioned adjacent to and upstream and downstream of the image-forming station, respectively, holding therebetween and conveying a photosensitive paper, the second and third rollers rotating at the same circumferential speed and operating synchronously with the movement of the original carrier during formation of an image on the photosensitive paper, the first rollers being provided with release means and the photosensitive paper held by the first rollers being released before the photosensitive paper passes the image-forming station.

According to a preferred embodiment, there are provided means for moving the original carrier reciprocatingly, means for rotating the second and third rollers synchronously with the reciprocating movement of the original carrier, and means for rotating the second and third rollers only in the direction in which a photosensitive paper is conveyed.

According to another preferred embodiment, the first rollers include an upper conveying roller and a lower conveying roller, the upper conveying roller being provided with means for lifting the roller, whereby the lifting means operates before the arrival of the leading end of a photosensitive paper at the image-forming station, and the photosensitive paper held by the first rollers is thus released.

According to the present invention as constituted above, when a photosensitive paper held between the first rollers located upstream of the image-forming station arrives at the image-forming station, the holding action of the first rollers is released, the photosensitive paper is held between the second rollers positioned adjacent to and upstream of the image-forming station, image-forming is started at the image-forming station, and the photosensitive paper is then conveyed and held between the third rollers positioned adjacent to and downstream of the image-forming station, thus the photosensitive paper is conveyed at a certain relationship to the movement of the original carrier, an image is formed thereon at the image-forming station, and the paper is advanced to the subsequent developing station and photographic fixing station. In this way, the blurring of the image does not occur at the image-forming station and an exact copy of the original image can be reproduced on the photosensitive paper.

DESCRIPTION OF THE PREFERRED EMBODIMENT

Prior to a description of the embodiments of the present invention, an outline of a conventional copying machine will be given.

Figure 1:
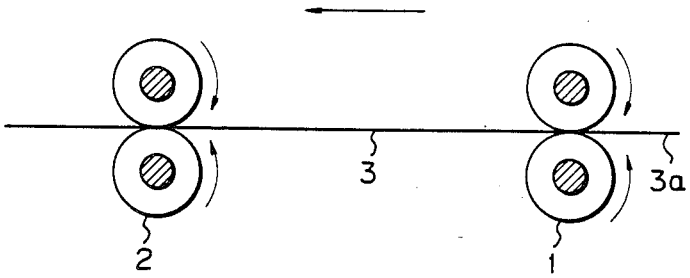
Fig. 1 PRIOR ART
FIG. 1 is a schematic view of a prior art means for conveying a photosensitive paper.

In a conventional copying machine, when a photosensitive paper is conveyed to an image-forming station, usually pairs of conveying rollers 1 and 2 are located upstream and downstream of a photosensitive paper 3, respectively, as shown in FIG. 1, these conveying rollers 1 and 2 hold the photosensitive paper 3 therebetween and convey the paper 3 at the same speed in the direction shown by an arrow.

In such a conventional photosensitive paper conveying device, when the trailing end 3*a* of the photosensitive paper 3 leaves the pair of upstream rollers 1, the photosensitive paper 3 is released from the influence of the pair of upstream rollers 1, for example, the pressure between the rollers 1 and the friction force with the rollers 1, thus the pair of downstream rollers 2 do not rotate correctly. Consequently, the photosensitive paper 3 is not properly conveyed. Thus, in a copying machine in which an original carrier and a photosensitive paper move together at a certain relationship to each other, and at the same time, an image is formed on the photosensitive paper, the image becomes blurred, and thus it is impossible to reproduce an exact copy of an original image on the photosensitive paper.

The embodiments of the present invention will now be described with reference to the accompanying drawings.

Figure 2:
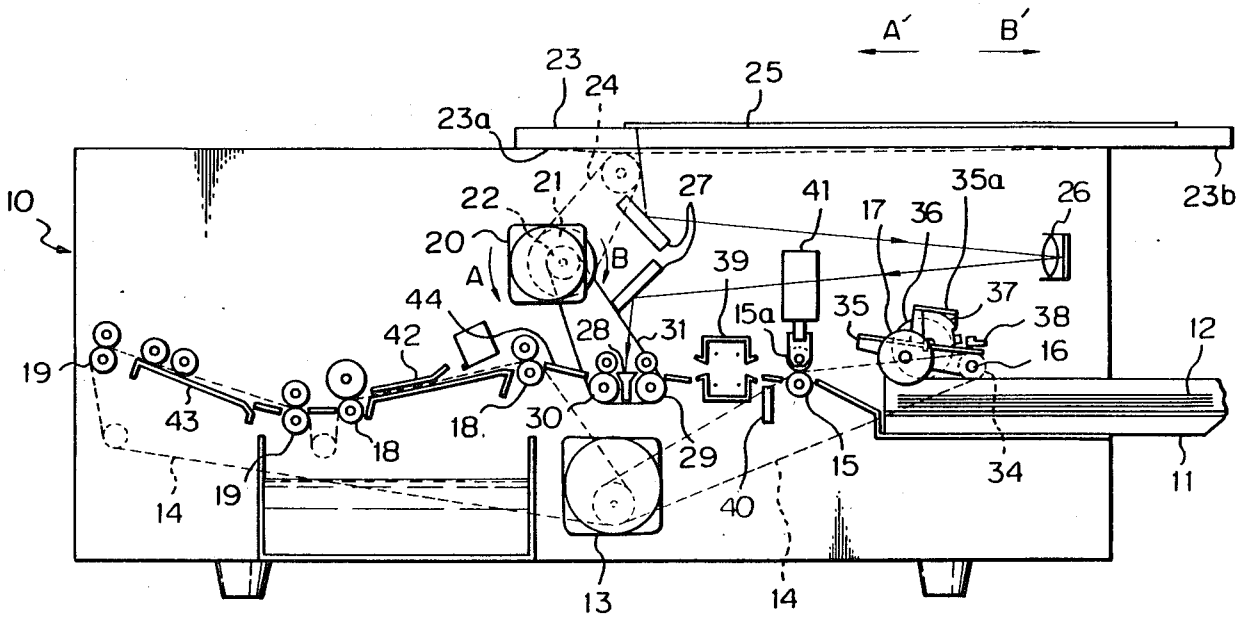
FIG. 2 is a general construction view of an embodiment of the present invention.

In FIG. 2, a machine body generally represented by numeral 10 is fitted with a paper cassette 11, with photosensitive papers 12 set in the paper cassette 11. The rotation of a first drive motor 13 is transmitted to a paper feed roller 17 via a first conveying roller 15 and a rotary shaft 16, and to developing station rollers 18 and photographic fixing station rollers 19, by transmission means such as chains 14 and the like, respectively.

A second drive motor 20 is fixed at the rotary shaft thereof with a first pulley 21 and a second pulley 22.

An end of a wire 24 is fixed to an end 23*a* of an original carrier 23, the wire 24 is wound several times around the first pulley 21 and the terminal end thereof then fixed to the other end 23*b* of the original carrier 23 while maintaining a sufficient tension thereon. Thus, the original carrier 23 can be moved in the left and right directions in response to the direction of rotation of the second drive motor 20.

The second pulley 22 is fitted with a transmission means such as a belt 31 and the like in order to rotate second and third pairs of conveying rollers 29 and 30 located adjacent to and upstream and downstream of an image-forming station 28, respectively. The image-forming station 28 forms an image on the photosensitive paper 12 by collecting light rays reflected from an original 25 on the original carrier 23 through mirrors 27 and a mirror lens 26.

Figure 3:
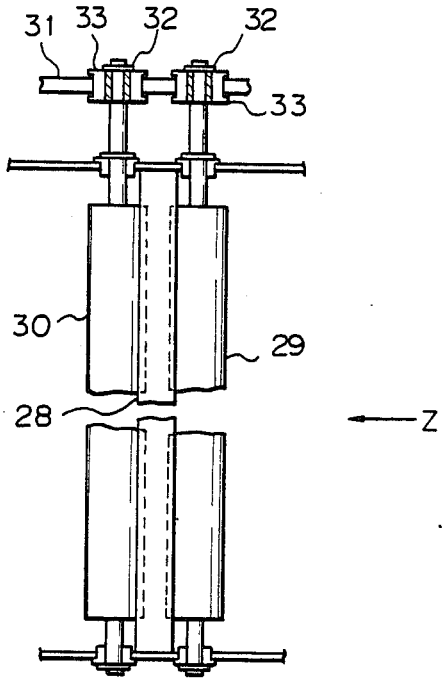
FIG. 3 is a plan view of conveying rollers at the image-forming station in the embodiment of the present invention.

As shown in FIG. 3, the second and the third conveying rollers 29 and 30 at the image-forming station 28 are provided at the ends thereof with pulleys 33, 33 having one-way clutches 32, 32, respectively, for driving these rollers 29, 30. The one-way clutches 32 are attached to each end of the second and third rollers 29 and 30 in such a way that the rollers 29, 30 are rotated by engagement with the clutches 32 when the photosensitive paper is conveyed from upstream to downstream as shown by arrow Z. That is, as shown in FIG. 2, the second and third conveying rollers 29, 30 are rotated only when the second drive motor 20 rotates in the direction of arrow A, and when the second drive motor 20 rotates in the direction of arrow B, the pulleys 33 run idle and the second and third conveying rollers 29 and 30 do not rotate.

Conversely, the original carrier 23 is moved in the direction of arrow A′ when the second drive motor 20 rotates in the direction of arrow A, and is moved in the direction of arrow B′ when the second drive motor 20 rotates in the direction of arrow B. The outer diameters of the second and third conveying rollers 29 and 30 are the same.

In this way, since the reciprocating movement of the original carrier 23 and the one-way rotation of the second and third conveying rollers 29 and 30 are carried out synchronously, the movement of the original carrier 23 and the conveying of the photosensitive paper 12 have a certain relationship with each other.

A paper feed roller 17 will be described hereinafter.

The rotation of the paper feed roller 17 is caused by a sprocket 34 fixed to a rotary shaft 16. The paper feed roller 17 is held by an arm 35 swinging around the rotary shaft 16, a projection 35*a* attached to the arm 35 comes into contact with a displacement cam 37 fixed on a third drive motor 36, and thus the position of the arm 35 is controlled within a certain range. That is, the rotation of the third drive motor 36 causes the arm 35 to move up and down so as to move the paper feed roller 17 up and down, and thus causes the paper feed roller 17 to come into contact with and feed the photosensitive paper 12 to the next stage. The third drive motor 36 is stopped at a predetermined position by a magnetic sensor 38, and at this position, the paper feed roller 17 normally does not come into contact with the photosensitive paper 12 but makes only one revolution according to the drive signal from the third drive motor 36.

In the embodiment of the present invention constituted above, when a print switch (not shown) is ON, the first drive motor 13 rotates the first conveying roller 15, the rotary shaft 16, the paper feed roller 17, the developing station rollers 18 and the photographic fixing station rollers 19. Also, the third drive motor 36 rotates and the displacement cam 37 then moves the paper feed roller 17 downward, thus the paper feed roller 17 comes into contact with the photosensitive papers 12, drawing out only one sheet of paper 12 at a time. The drawn out paper 12 is further conveyed until the leading end of the paper 12 is held between the first conveying roller 15 and an upper first conveying roller 15*a* located thereabove. At the time when the paper 12 is conveyed into a charger 39, the displacement cam 37 makes one revolution and lifts the paper feed roller 17, thus the paper feed roller 17 is withdrawn from contact with the photosensitive papers 12. A detecting means 40 is arranged between the first conveying roller 15 and the charger 39, and when a certain time has passed after the leading end of the photosensitive paper 12 has passed through the detecting means 40, the second drive motor 20 rotates, and thus the original carrier 23 starts to move in the direction of arrow A′. At the same time, the second and third conveying rollers 29 and 30 start to rotate, the photosensitive paper 12 is conveyed from the charger 39 to the second conveying rollers 29, before the leading end of the photosensitive paper 12 arrives at the image-forming station 28, and a solenoid 41 installed on the machine body 10 operates and lifts the upper first conveying roller 15*a*. Thus, the photosensitive paper 12 is no longer held between the conveying rollers 15 and 15*a*. From this time, the photosensitive paper 12 is conveyed by only the second conveying rollers 29, and image formation onto the paper 12 of the original image is started at the image-forming station 28. Further, the photosensitive paper 12 is conveyed to and held between the third conveying rollers 30, at the image-forming station 28, held between the second and third conveying rollers 29 and 30, a copy of the original image is formed on the photosensitive paper 12 while it is conveyed in a certain relationship to the travel speed of the original carrier 23, and the paper 12 is then advanced to the following developing station 42 and photographic fixing station 43. Since the conveying speed of the photosensitive paper 12 at the developing process and the photographic fixing process is set to be less than that of the second and third conveying rollers 29 and 30, the photosensitive paper 12 loops gradually on a guide plate 44. Consequently, the conveying speed of the photosensitive paper 12 while passing through the image-forming station 28 is determined by the second and third conveying rollers 29 and 30.

If the upper first conveying roller 15*a* is not lifted, the moment the trailing end of the photosensitive paper 12 leaves the pair of first conveying roller 15 and upper first conveying roller 15*a*, the load of the conveying roller 15 against the second conveying rollers 29 is removed, and thus the conveying rollers 29 begin to rotate incorrectly. Consequently, the photosensitive paper 12 is not properly conveyed, and blurring occurs in the picture image formed at the image-forming station 28.

In the above embodiment, however, since the upper first conveying roller 15*a* is lifted and the holding force between the first conveying rollers 15 and 15*a* is released before the photosensitive paper 12 arrives at the image-forming station 28, blurring does not occur in the picture image at the image-forming station 28.

Then, when the original carrier 23 moves in the direction of arrow A′ and arrives at the left end of the track thereof, the second drive motor 20 rotates is reverse in the direction of arrow B and causes the original carrier 23 to return in the direction of arrow B′. At this time, if the pulleys 33 of the second and third conveying rollers 29 and 30 are not provided with one-way clutches 32, the second and third conveying rollers 29 and 30 also would be rotated in reverse. When the original carrier 23 begins to return in the direction of arrow B′, if the length of the photosensitive paper 12 is large, since the trailing end of the paper 12 is still held between the second and third conveying rollers 29 and 30, the following problem would arise. The leading end of the paper 12 would be pulled to the downstream side by the developing station rollers 18 and the photographic fixing station rollers 19, but the trailing end of the paper 12 would be pulled in the opposite direction to the upstream side by the second and third conveying rollers 29 and 30.

In this embodiment, however, since the pulleys 33 are provided with one-way clutches 32, even if the second drive motor 20 rotates in the direction of arrow B, the rotation of the second drive motor 20 is not transmitted to the second and third conveying rollers 29 and 30, these conveying rollers 29 and 30 run free, and thus the photosensitive paper 12 can be conveyed to the downstream side by the developing station rollers 18 and the photographic fixing station rollers 19 without hindrance.

According to the present invention, since the photosensitive paper is conveyed by only the conveying rollers adjacent to the image-forming station when the original image is formed and is not subjected to the influence of the other groups of rollers, the photosensitive paper can be conveyed in a certain relationship to the movement of the original carrier and blurring of the picture image can be prevented and thus an exact copy of the picture image of the original can be reproduced on the photosensitive paper.

We claim:

1. A photosensitive paper conveying device of a copying machine comprising:

a body;

an original carrier movably mounted on said body;

a photosensitive paper receiving member attached to said body;

an image-forming station forming an image on a photosensitive paper;

photosensitive paper conveying means located downstream of said photosensitive paper receiving member, conveying a photosensitive paper from said photosensitive paper receiving member to said image-forming station;

said photosensitive paper conveying means including a first pair of rollers located apart from said image-forming station and between said photosensitive paper receiving member and said image-forming station, holding therebetween and conveying a photosensitive paper, and including a second and a third pairs of rollers positioned adjacent to and upstream and downstream of said image-forming station, respectively, holding therebetween and conveying a photosensitive paper, said second and third rollers rotating at the same circumferential speed and operating synchronously with the movement of said original carrier during formation of an image on said photosensitive paper; and said first rollers being provided with release means, and the photosensitive paper held by said first rollers being released before said photosensitive paper passes said image-forming station.

2. A photosensitive paper conveying device according to claim 1, wherein there are provided means for moving said original carrier reciprocatingly and means for rotating said second and third rollers synchronously with said reciprocating movement of said original carrier.

3. A photosensitive paper conveying device according to claim 2, wherein said second and third rollers are provided with means for rotating only in a direction in which a photosensitive paper is conveyed.

4. A photosensitive paper conveying device according to claim 3, wherein said rotating means are one-way clutches.

5. A photosensitive paper conveying device according to claim 1, wherein said first rollers include an upper conveying roller and a lower conveying roller, said upper conveying roller being provided with lifting means, whereby said lifting means operates before arrival of a photosensitive paper at said image-forming station, the photosensitive paper held by said first rollers thus being released.

6. A photosensitive paper conveying device according to claim 5, wherein said lifting means is operated by a solenoid installed on the body and lifts said upper first conveying roller before the leading end of the photosensitive paper arrives at the image-forming station.

* * * * *

UNITED STATES PATENT OFFICE

CERTIFICATE OF CORRECTION

Patent No. 4,681,313 Dated July 21, 1987

Inventor(s) Yokoyama, et al.

It is certified that error appears in the above-identified patent and that said Letters Patent are hereby corrected as shown below:

On the Title Page, Item [19] and [75]
The inventor's name "Yasuyuki Yokovama" should be -- Yasuyuki Yokoyama --.

Signed and Sealed this

Ninth Day of February, 1988

*Attest:*

DONALD J. QUIGG

*Attesting Officer*

*Commissioner of Patents and Trademarks*